US012697656B2

(12) United States Patent
Hoferer et al.

(10) Patent No.: US 12,697,656 B2
(45) Date of Patent: Aug. 4, 2026

(54) METHOD FOR PRODUCING A COMPONENT WHICH HAS A TOOTHING PROFILE, AND TOOL DEVICE

(71) Applicant: Schaeffler Technologies AG & Co. KG, Herzogenaurach (DE)

(72) Inventors: Patrick Hoferer, Oberkirch (DE); Michael Schlosser, Bietigheim (DE); Wilfried Schwenk, Achern-Mösbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 371 days.

(21) Appl. No.: 18/287,050

(22) PCT Filed: Mar. 16, 2022

(86) PCT No.: PCT/DE2022/100204

§ 371 (c)(1),
(2) Date: Oct. 16, 2023

(87) PCT Pub. No.: WO2022/218462

PCT Pub. Date: Oct. 20, 2022

(65) Prior Publication Data

US 2024/0367218 A1 Nov. 7, 2024

(30) Foreign Application Priority Data

Apr. 16, 2021 (DE) ..... 10 2021 109 639.1

(51) Int. Cl.
*B21K 1/30* (2006.01)

(52) U.S. Cl.
CPC ..... *B21K 1/30* (2013.01)

(58) Field of Classification Search
CPC . B21K 1/28; B21K 1/30; B21K 1/305; B21K 1/54; B21K 1/76; B21K 1/767;
(Continued)

(56) References Cited

U.S. PATENT DOCUMENTS 716,241 A 12/1902 Jones
2,782,663 A 2/1957 Clevenger
(Continued)

FOREIGN PATENT DOCUMENTS

CH 687597 A5 1/1997
CN 1192387 A 9/1998
(Continued)

OTHER PUBLICATIONS

Source: Office Action Corresponding to Chinese Patent Application No. 202280026717.6, dated Nov. 4, 2025.

*Primary Examiner* — Teresa M Ekiert

(57) ABSTRACT

A method for producing a component which has a toothing profile includes, in a first step, inserting a component blank into a mounting of a tool device configured to receive a pressing force during a movement of a pressing part of the tool device in a vertical movement direction, and, in a second step, pressing the toothing profile into the component blank using a rotational body which is coupled to the pressing part via a joint rod. When the pressing part is moved in the movement direction, the rotational body is pressed in a direction of the component blank and rolls along the component blank such that the toothing profile is formed.

20 Claims, 2 Drawing Sheets

(58) Field of Classification Search
CPC . B21J 9/022; B21H 3/02; B21H 3/022; B21H 3/04; B21H 3/042; B21H 3/044; B21H 3/06; B21H 3/065; B21H 5/00; B21H 7/18; B21H 7/187; B21H 9/02
See application file for complete search history.

(56) References Cited

U.S. PATENT DOCUMENTS

| | | | | |
|---|---|---|---|---|
| 4,322,961 | A * | 4/1982 | Greis | B21H 3/04 72/104 |
| 4,941,339 | A * | 7/1990 | Soehnlein | B21K 1/54 72/406 |
| 5,546,781 | A | 8/1996 | Krapfenbauer | |
| 5,628,222 | A | 5/1997 | Yasuda et al. | |
| 6,000,267 | A | 12/1999 | Yagi | |
| 8,661,677 | B2 | 3/2014 | Omi et al. | |
| 2011/0107806 | A1 * | 5/2011 | Behrens | B21H 3/02 72/454 |

FOREIGN PATENT DOCUMENTS

| | | | |
|---|---|---|---|
| CN | 1796033 | A | 7/2006 |
| CN | 202752702 | U | 2/2013 |
| CN | 103752953 | A | 4/2014 |
| CN | 106660108 | A | 5/2017 |
| CN | 109415079 | A | 3/2019 |
| CN | 109759527 | A | 5/2019 |
| CN | 211387226 | U | 9/2020 |
| DE | 1237051 | B | 3/1967 |
| DE | 3243191 | A1 | 5/1984 |
| DE | 102004056921 | A1 | 6/2006 |
| EP | 0344117 | A2 | 11/1989 |
| EP | 0344117 | B1 | 12/1993 |
| EP | 0860225 | A2 | 8/1998 |
| EP | 0860225 | B1 | 7/2003 |
| EP | 3481700 | A1 | 5/2019 |
| EP | 3481700 | B1 | 8/2020 |
| JP | S59110444 | A | 6/1984 |
| JP | H0225234 | A | 1/1990 |
| JP | H06246383 | A | 9/1994 |
| JP | H08155575 | A | 6/1996 |
| JP | H10296373 | A | 11/1998 |
| SU | 390857 | A1 | 7/1973 |

* cited by examiner

METHOD FOR PRODUCING A COMPONENT WHICH HAS A TOOTHING PROFILE, AND TOOL DEVICE

CROSS-REFERENCE TO RELATED APPLICATIONS

This application is the U.S. National Phase of PCT Appln. No. PCT/DE2022/100204 filed Mar. 16, 2022, which claims priority to DE 102021109639.1 filed Apr. 16, 2021, the entire disclosures of which are incorporated by reference herein.

TECHNICAL FIELD

The present disclosure relates to a method for producing a component/transmission component having a toothing profile, preferably a gear rack. The component is further preferably designed as a steering rod used in a motor vehicle (for example in a steering gear).

BACKGROUND

In general, various cold forming methods are already known in which the component to be machined is held between at least two spaced components of a rolling tool, and is shaped according to the geometry thereof. Examples of this are shown in DE 1 237 051 A, US 716 241 A and U.S. Pat. No. 2,782,663 A.

In the case of the methods known from the prior art, however, it has been found that the tool devices used and the methods used to manufacture toothed components are implemented in a relatively complex manner.

SUMMARY

The present disclosure produces a tooth profile on a component using the simplest possible means.

A method, according to an exemplary embodiment, for producing a component having a toothing profile is provided, wherein in a first step a) a component blank is inserted into a mounting of a tool device to receive a pressing force when a pressing part of the tool device moves in a vertical movement direction, and in a second step b) the toothing profile is pressed into the component blank using a rotational body coupled to the pressing part via a joint rod (in the sense of a connecting rod/a conrod), wherein the rotational body is pressed in the direction of the component blank during the movement of the pressing part in the movement direction and rolls along the component blank so that the toothing profile is formed.

A tool device is designed for producing a component having a toothing profile and a vertically movable pressing part, a mounting prepared for receiving a component blank, a rotational body and a joint rod that couples the rotational body with the pressing part, wherein the joint rod connects the rotational body to the pressing part in such a way that when the pressing part is moved vertically to form the toothing profile, the rotational body is pressed in the direction of the component blank and rolls along the component blank/an outer circumference of the component blank.

Such a production of the toothing profile means that as few components as possible are required for the finished shaping of the component. On the one hand, this significantly simplifies the structure of the tool device, and on the other hand, the manufacturing process is implemented as efficiently as possible. In particular, to implement different toothings, preferably only the rotational body must be exchanged.

It is also advantageous if the rotational body (preferably on the radial outside thereof) directly has a negative mold of the toothing profile. This further simplifies the structure, wherein the toothing profile is pressed into the component blank by the direct pressing of the rotational body against the component blank.

Furthermore, it is expedient if the tool device is implemented as a progressive tool/a progressive press. As a result, particularly precise toothing profiles are formed.

If the progressive tool is designed in such a way that the toothing profile is formed in a number of stages, the manufacturing efficiency is increased.

Accordingly, it is also advantageous if the toothing profile is formed in a plurality of cold forming stages, wherein each cold forming stage has a rotational body coupled to the pressing part via a joint rod. This further improves the production efficiency.

In this regard, it is also advantageous if the rotational bodies of the various cold-forming stages differ in terms of a toothing diameter and/or a toothing depth.

If the component blank is elongate, for example as a gear rack blank, and is inserted in the first step (with the longitudinal axis thereof) at an angle to the vertical movement direction of the pressing part, the rotational body can roll along the component blank with as little wear as possible.

It is also advantageous if the component blank (with respect to the longitudinal axis thereof) is inserted in the first step a) at an angle of between 20° and 50°, preferably between 25° and 35°, approximately 30°, relative to a horizontal plane. That horizontal plane is in turn perpendicular to the vertical movement direction of the pressing part. This results in the rotational body being received on the joint rod with as little wear as possible.

It is also expedient if the rotational body is guided in the rolling movement thereof in a housing which can be further connected to a base which receives the mounting. This results in a robust mounting of the rotational body.

In this regard, it is also advantageous if the rotational body is connected to the joint rod by means of a bearing shaft and/or is guided in the housing (preferably at an angle to the vertical movement direction of the pressing part).

If the rotational body, which can be implemented as a roller, has the negative shape of the toothing profile on only part of the outer circumference thereof, it can be supported as robustly as possible.

The rotational body can be designed to form irregular toothing profiles.

In other words, according to the present disclosure, a cold-formed gear rack can be produced in a multi-stage tool, wherein the toothing profile is produced by the rolling of a shaping roller (rotational body), and wherein the vertical movement of the press (pressing part) via a connecting rod (joint rod) is converted into a rolling movement. There is thus a profile that is unrolled by a roller, so that the profile is pressed into the workpiece, wherein the roller is moved via a type of connecting rod.

BRIEF DESCRIPTION OF THE DRAWINGS

In the following, the present disclosure is now explained in more detail with reference to figures.

In these.

The figures are only schematic in nature and serve only for understanding the present disclosure. The same elements are provided with the same reference symbols.

DETAILED DESCRIPTION

Figure 3:
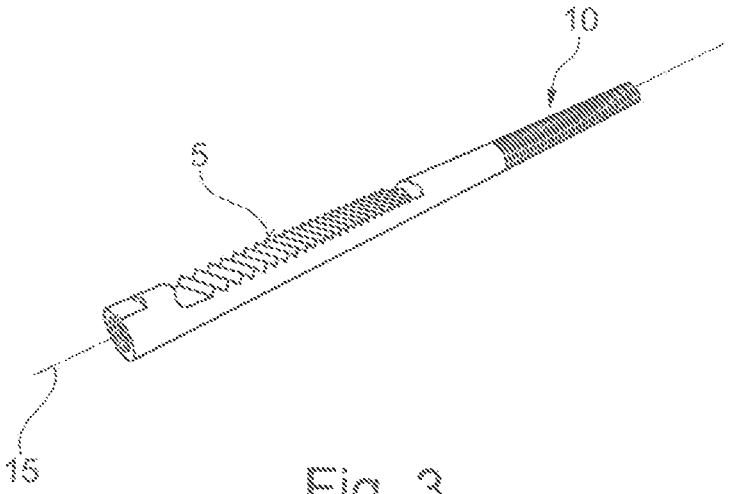
FIG. 3 shows a perspective view of a gear rack produced by means of the tool device according to FIG. 1.

FIG. 3 shows a component 10 in the form of a gear rack that has been completely manufactured using the method according to the present disclosure. The component 10 is specifically implemented as a steering rod and is therefore preferably used in a steering system of a motor vehicle. In further embodiments according to the present disclosure, however, the component 10 is also implemented as another component 10 designed with a toothing profile 5, for example as a gear wheel.

Figure 1:
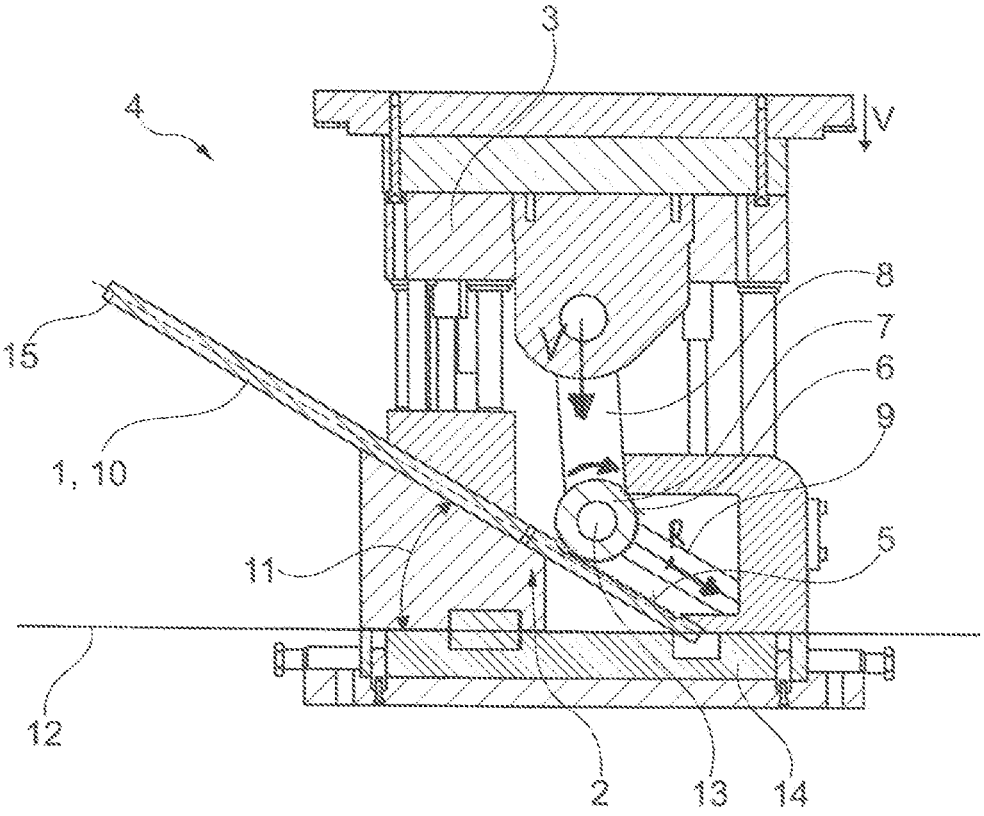
FIG. 1 shows a side view of a partially illustrated tool device designed and used according to the present disclosure according to an exemplary embodiment, wherein a rotational body inserted in the tool device and a joint rod which couples this rotational body to a vertically movable pressing part are clearly visible.
Figure 2:
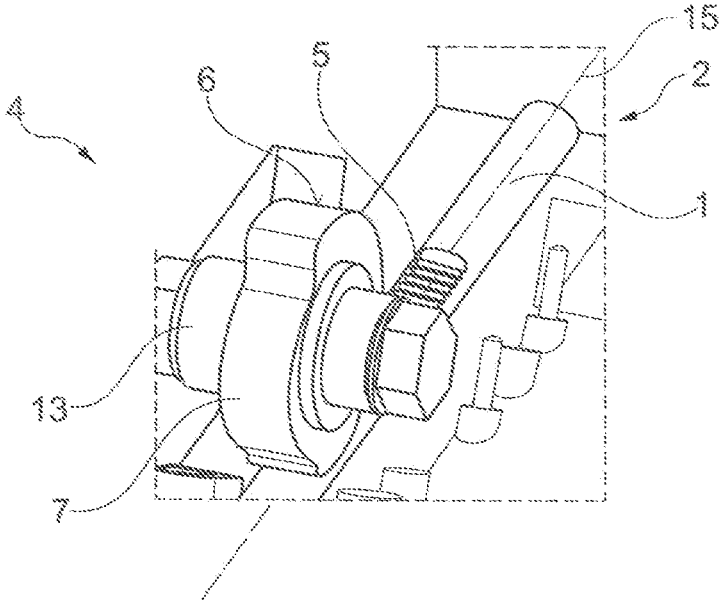
FIG. 2 shows a perspective detailed representation of the machine tool according to FIG. 1 in the area of the rotational body and a component blank to be machined with the aid of the rotational body.

In the present embodiment, the finished component 10 has a toothing profile 5 in a longitudinal section due to the design thereof as a gear rack, which is shown in this FIG. 3 as helical toothing. In FIGS. 1 and 2, however, the toothing profile 5 is shown as straight toothing, wherein in principle the most varied of toothings/toothing profiles 5, preferably also irregular toothing profiles 5, can be implemented using the manufacturing method described below:

In FIGS. 1 and 2, a tool device 4 designed to implement the method according to the present disclosure is illustrated, by means of which the component 10 according to FIG. 3 can be produced. The tool device 4 is implemented as a progressive tool/a progressive press. A production stage can be seen in FIG. 1.

FIG. 1 shows that the tool device 4 has a base 14 which defines a horizontal plane 12/extends in this horizontal plane 12. A pressing part 3 can be moved relative to the base 14 in a vertical movement direction V, i.e., perpendicular to the horizontal plane 12. When the tool device 4 is in operation, a movement of the pressing part 3 generates/transmits a forming force that forms the toothing profile 5.

A mounting 2 designed to support a pressing force transmitted by the pressing part 3 is received on the base 14. The mounting 2 is also designed in such a way that a component blank 1 to be produced (here in the form of a gear rack blank) can be clamped at an angle to the movement direction V and is also already clamped in this position in FIG. 1. In a clamped state of the component blank 1 shown in FIG. 1, this component blank 1 is clamped/inserted inclined at an angle 11 of 30° relative to the horizontal plane 12 in relation to the longitudinal axis 15 thereof.

A rotational body 7 in the form of a roller, which has a negative mold 6 of the toothing profile 5, is provided for forming the toothing profile 5 by cold forming. The rotational body 7 is rotatably supported at one end of a joint rod 8 inserted according to a connecting rod. The joint rod 8 serves to couple the movement of the rotational body 7 to the pressing part 3. Accordingly, the joint rod 8 is rotatably attached to the pressing part 3 with the end thereof facing away from the rotational body 7.

Furthermore, the rotational body 7 is guided in a housing 9 of the tool device 4 so as to be movable along a longitudinal axis 15 of the clamped component blank 1. As can be seen in this respect in FIG. 2, for example, the rotational body 7 is received on a bearing shaft 13. This bearing shaft 13 is guided in the housing 9 with the areas thereof protruding from the rotational body 7 and is also mounted on the joint rod 8.

It has proven to be particularly advantageous if the joint rod 8 is designed with two arms, and one arm is mounted on the bearing shaft 13 on each side of the rotational body 7.

According to the present disclosure, the rotational body 7 is thus held on the pressing part 3 via the joint rod 8 in such a way that a vertical movement of the pressing part 3 (movement along the movement direction V) results in a direct pressing onto/pressing in of the rotational body 7 with the negative mold 6 thereof (also referred to as a negative profile) onto/in the component blank 1 and thus the toothing profile 5 is pressed by cold forming. At the same time, the rotational body 7 rolls along the movement direction V along the component blank 1 during the movement of the pressing part 3.

Figure 4:
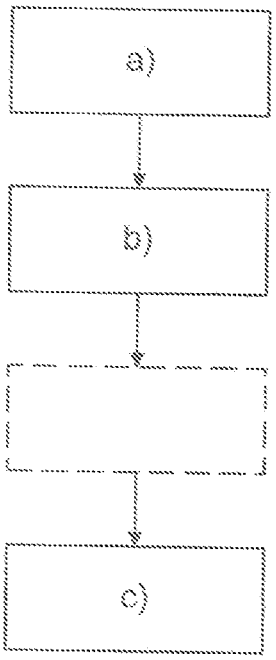
FIG. 4 shows a schematic flow chart for implementing a production method according to the present disclosure using the tool device according to FIG. 1.

A method according to the present disclosure is illustrated schematically in FIG. 4. In a first step a), the component blank 1 is clamped/inserted into the mounting 2. Subsequently, in a second step b), the toothing profile 5 is shaped in the manner already described. Accordingly, the toothing profile 5 is formed by moving the pressing part 3 towards the component blank 1 and thus by pressing the rotational body 7 into the component blank 1.

In this context, it should be pointed out that the toothing profile 5 can be formed in several individual manufacturing stages/cold-forming stages. In this case, rotational bodies 7 of different dimensions can be inserted at several stations/cold-forming stages (located behind or in front of the plane of the drawing in FIG. 1), which in turn are connected to the pressing part 3 via a corresponding joint rod 8. The rotational bodies 7 differ in particular in their toothing diameter or toothing depth of their negative mold 6. Consequently, in a first partial step, the toothing profile 5 can be produced with a first depth and in at least one further, second step the toothing profile 5 is further formed/produced with a second depth. Accordingly, any number of cold-forming stages can be implemented until finally the component 10 according to FIG. 3 is completed and is removed from the tool device 4 in a step c).

LIST OF REFERENCE SYMBOLS

1 Component blank
2 Mounting
3 Pressing part
4 Tool device
5 Toothing profile
6 Negative mold
7 Rotational body
8 Joint rod
9 Housing
10 Component
11 Angle
12 Horizontal plane
13 Bearing shaft
14 Base
15 Longitudinal axis
V Vertical movement direction

The invention claimed is:

1. A method for production of a component having a toothing profile, comprising in a first step inserting a component blank into a mounting of a tool device configured to receive a pressing force in response to a pressing part of the tool device being inserted in a vertical movement direction, in a second step, pressing the toothing profile into the component blank using a rotational body coupled to the pressing part via a joint rod, wherein, when the pressing part is moved in vertical movement direction, the rotational body is pressed in a direction of the component blank; and rolls along the component blank so that the toothing profile is formed.

2. The method according to claim 1, wherein the rotational body directly has a negative mold of the toothing profile on an outer circumference thereof.

3. The method according to claim 1, wherein the tool device is implemented as a progressive tool.

4. The method according to claim 1, wherein the toothing profile is formed in a plurality of cold-forming stages, wherein one respective rotational body is coupled to the pressing part via on respective joint rod for each cold-forming stage.

5. The method according to claim 4, wherein each of the rotational bodies includes, on a respective outer circumference thereof, a negative mold of a respective toothing profile corresponding to the respective cold-forming stage.

6. The method according to claim 5, wherein the negative molds corresponding to each cold-forming stage differ in terms of at least one of a toothing diameter and a toothing depth.

7. The method according to claim 1, wherein the component blank is elongated and, in the first step, is inserted at an angle oblique to the vertical movement direction of the pressing part.

8. The method according to claim 7, wherein, in the first step, the angle is between 20° and 50° relative to a horizontal plane defined by the tool device.

9. The method according to claim 1, wherein the rotational body is guided in a housing while rolling along the component blank.

10. A tool device for producing a component having a toothing profile, comprising:

a vertically movable pressing part, a mounting configured to receive a component blank, and a rotational body and a joint rod which couples the rotational body with the pressing part, the joint rod connecting the rotational body to the pressing part in such a way that, when the pressing part is moved vertically to form the toothing profile, the rotational body is pressed in a direction of the component blank and rolls along the component blank.

11. The tool device according to claim 10, wherein the rotational body is connected to the joint rod via a bearing shaft.

12. The tool device according to claim 11, wherein the rotational body is guided in a housing while rolling along the component blank.

13. The tool device according to claim 10, wherein the rotational body is guided in a housing while rolling along the component blank.

14. The tool device according to claim 10, wherein the rotational body directly has a negative mold of the toothing profile on an outer circumference thereof.

15. The tool device according to claim 10, wherein the tool device is implemented as a progressive tool.

16. The tool device according to claim 10, wherein the mounting orients the component blank at an angle oblique to a horizontal plane defined by the tool device.

17. The tool device according to claim 16, wherein the angle is between 20° and 50° relative to the horizontal plane.

18. The tool device according to claim 9, further comprising a further rotational body and a further joint rod which couples the further rotational body with the pressing part, the further joint rod connecting the further rotational body to the pressing part in such a way that, when the pressing part is moved vertically to form the toothing profile, the further rotational body is pressed in the direction of the component blank and rolls along the component blank.

19. The tool device according to claim 18, wherein the rotational body has a negative mold of a first toothing profile on an outer circumference thereof, and the further rotational body has a negative mold of a second toothing profile on an outer circumference thereof.

20. The tool device according to claim 19, wherein the first and second toothing profiles differ in terms of at least one of a toothing diameter and a toothing depth.

* * * * *